United States Patent [19]

Horgan

[11] Patent Number: 4,489,148

[45] Date of Patent: Dec. 18, 1984

[54] OVERCOATED PHOTORESPONSIVE DEVICE

[75] Inventor: Anthony M. Horgan, Pittsford, N.Y.

[73] Assignee: Xerox Corporation, Stamford, Conn.

[21] Appl. No.: 488,250

[22] Filed: Apr. 25, 1983

[51] Int. Cl.[3] ..... G03G 5/06; G03G 5/08; G03G 5/14

[52] U.S. Cl. ..... 430/59; 430/57; 430/58; 430/60; 430/67

[58] Field of Search ..... 430/57, 58, 59, 60, 430/66, 67

[56] References Cited

U.S. PATENT DOCUMENTS

| | | | |
|---|---|---|---|
| 3,915,076 | 10/1975 | Gotoda | 430/58 |
| 4,066,455 | 1/1978 | Mey et al. | 430/58 X |
| 4,123,269 | 10/1978 | VonHoene et al. | 430/67 X |
| 4,297,424 | 10/1981 | Hewitt | 430/67 X |
| 4,378,415 | 3/1983 | Chu | 430/59 X |
| 4,410,616 | 10/1983 | Griffiths et al. | 430/59 |
| 4,415,639 | 11/1983 | Horgan | 430/59 X |

FOREIGN PATENT DOCUMENTS

| | | | |
|---|---|---|---|
| 51-97433 | 8/1976 | Japan | 430/58 |
| 57-56942 | 4/1982 | Japan | 430/59 |

OTHER PUBLICATIONS

Tateishi et al., "Photoreceptor for LED Printer", E.C.C. Jour., vol. 31, No. 3, 1982, pp. 597-604.

Arishima et al., "Electrophotographic Photoreceptor With High Sensitivity in the Near-Infrared Region", Appl. Phys. Lett., 40, (3), Feb. 1982, pp. 279-281.

*Primary Examiner*—Roland E. Martin

*Attorney, Agent, or Firm*—E. O. Palazzo

[57] ABSTRACT

This invention is directed to an improved photoresponsive device comprised of a substrate, a hole transport layer, an adhesive layer, an organic photoconductive layer sensitive to infrared radiation, an inorganic photogenerating layer, and an optional polymeric overcoating layer.

44 Claims, 6 Drawing Figures

OVERCOATED PHOTORESPONSIVE DEVICE

BACKGROUND

This invention is generally directed to an improved overcoated photoresponsive device, and more specifically to an improved photoresponsive device where the sensitivity thereof can be varied or enhanced allowing such a device to be capable of being responsive to visible light, and infra-red illumination needed for laser printing. In one important embodiment of the present invention, there is included in the device situated between a photogenerating layer and a hole transport layer, a composition such as a photoconductive composition, which composition is primarily responsible for enhancing or reducing the intrinsic properties of the photogenerating layer in the infra-red and/or visible region of the spectrum thereby allowing such device to be sensitive to either visible light and/or infra-red wavelengths.

The formation and development of electrostatic latent images on the imaging surfaces of photoconductive materials by electrostatic means is well known, one such method involving the formation of an electrostatic latent image on the surface of a photosensitive plate, referred to in the art as a photoreceptor. A photoreceptor can be comprised of a conductive substrate containing on its surface a layer of photoconductive insulating material, and in many instances, there is incorporated therein a thin barrier layer situated between the substrate and the photoconductive layer, which layer prevents charge injection into the photoconductive layer upon charging of its surface. Charge injection in these devices adversely affects the quality of the resulting images.

Numerous different photoconductive members for use in xerography are known including for example, a homogeneous layer of a single material such as vitreous selenium, or composite layered devices, containing a photoconductive substance, dispersed in other substances. An example of one type of composite photoconductive layer used in xerography is described for example, in U.S. Pat. No. 3,121,006, wherein there is disclosed a number of layers comprising finely divided particles of a photoconductive inorganic compound dispersed in an electrically insulating organic resin binder. In a commercial form, there is coated coated on a paper backing the binder layer containing particles of zinc oxide uniformly dispersed in a resinous material. The binder materials disclosed in this patent contain a material which is incapable of transporting for any significant distance injected charge carriers generated by the photoconductive zinc oxide particles. Accordingly, as a result the photoconductive particles must be in a substantially contiguous particle to particle contact throughout the layer for the purpose of permitting charge dissipation required for a cyclic operation. Thus, with the uniform dispersion of photoconductive particles described a relatively high volume concentration of photoconductor material, about 50 percent by volume, is usually necessary in order to obtain sufficient photoconductor particle to particle contact for rapid discharge. This high photoconductive loading can result in destroying the physical continuity of the resinous material thus significantly reducing the mechanical properties of the binder layer. Illustrative examples of specific binder materials disclosed in this patent include, for example, polycarbonate resins, polyester resins, polyamide resins, and the like.

There are also known photoreceptor materials comprised of other inorganic or organic materials wherein the charge carrier generation and charge carrier transport functions are accomplished by discrete contiguous layers. Additionally, photoreceptor materials are disclosed in the prior art which include an overcoating layer of an electrically insulating polymeric material and in conjunction with this overcoated type photoreceptor there have been proposed of number of imaging methods. However, the art of xerography continues to advance and more stringent demands need to be met by the copying apparatus in order to increase performance standards, and to obtain higher quality images. The photoconductive imaging member of the present invention represents such an improved member and has other advantages as disclosed hereinafter.

Recently, there has been developed other layered photoresponsive devices including those comprised of generating layers and charge transport layers as disclosed in U.S. Pat. No. 4,265,990, and overcoated photoresponsive materials containing a hole injecting layer, covercoated with a transport layer, followed by an overcoating of a photogenerating layer and a top coating of an insulating organic resin, reference U.S. Pat. No. 4,251,612. Examples of generating layers disclosed in these patents include trigonal selenium and vanadyl phthalocyanine, while examples of transport layers that may be employed are comprised of certain diamines as mentioned herein. The disclosures of each of these patents, namely, U.S. Pat. Nos. 4,265,990 and 4,251,612 are totally incorporated herein by reference.

Many other patents are in existence describing photoresponsive devices including layered devices containing generating substances such as U.S. Pat. No. 3,041,167, which discloses an overcoated imaging member containing a conductive substrate, a photoconductive insulating layer, and an overcoating layer of an electrically insulating polymeric material. This member is utilized in an electrophotographic copying method by, for example, initially charging the member, with an electrostatic charge of a first polarity and imagewise exposing to form an electrostatic latent image which can be subsequently developed to form a visible image. Prior to each succeeding imaging cycle, the imaging member can be charged with an electrostatic charge of a second polarity which is opposite in polarity to the first polarity. Sufficient additional charges of the second polarity are applied so as to create across the member a net electrical field of the second polarity. Simultaneously, mobile charges of the first polarity are created in the photoconductive layer such as by applying an electrical potential to the conductive substrate. The imaging potential which is developed to form the visible image is present across the photoconductive layer and the overcoating layer.

There is also disclosed in Belgium Pat. No. 763,540, an electrophotographic member having at least two electrically operative layers, the first layer comprising a photoconductive layer which is capable of photogenerating charge carriers, and injecting the photogenerated hole into a continuous active layer containing a transport organic material which is substantially non-absorbing in the spectral region of intended use, but which is active in that it allows injection of photogenerating holes from the photoconductive layer causing these holes to be transported through the active layer. The active polymers selected for this device may be mixed with inactive polymers or non-polymeric materials.

In U.S. Pat. No. 3,041,116 there is disclosed a photoconductive material containing a transparent plastic material overcoated on a layer of vitreous selenium which is contained on a recording substrate. Apparently, in operation, the free surface of the transparent plastic is electrostatically charged to a desired polarity, followed by exposing the device to activating radiation, which generates a hole electron pair in the photoconductive layer, causing the electrons to move to the plastic layer, and neutralize the positive charges contained thereon, thus creating an electrostatic image.

Also, there is disclosed in U.S. Pat. Nos. 4,232,102 and 4,233,383 the use of trigonal selenium doped with sodium carbonate, sodium selenite, and trigonal selenium doped with barium carbonate, and barium selenite as photoresponsive imaging members.

Other representative patents disclosing layered photoresponsive devices include U.S. Pat. Nos. 4,115,116, 4,047,949 and 4,081,274.

There is also disclosed in a prior copending application an improved photoresponsive device containing a substrate, a hole blocking layer, an optional adhesive layer, an inorganic photogenerating layer, an organic photoconductive layer, and a top coating of a hole transport layer.

While the above-described photoresponsive devices are suitable for their intended purposes there continues to be a need for improved devices, particularly layered devices, which not only generate acceptable images but which can be repeatedly used in a number of imaging cycles without deterioration thereof from the machine environment or surrounding conditions. Additionally, there continues to be a need for improved layered imaging members wherein the materials selected for the respective layers are substantially inert to users of such devices, while simultaneously functioning as an imaging member. Furthermore, there continues to be a need for imaging members wherein adhesion of the layers such as, for example, the photogenerating layer to the substrate can be accomplished without the need for specific adhesive materials, while simultaneously improving the scratch resistance of the other layers such as the ground plane layer, improving the strength of the binder generating layer and providing a device of improved mechanical strength. Also, there continues to be a need for overcoated photoresponsive devices which are sensitive to a broad range of wavelengths, and more specifically are sensitive to infra-red light and visible light thereby allowing such devices to be useful in a number of imaging and printing systems. Additionally, there continues to be a need for improved photoresponsive devices which can be prepared with a minimum number of processing steps, and wherein the layers are sufficiently adhered to one another to allow the continuous use of such devices in imaging and printing systems with repetitive imaging and printing cycles.

SUMMARY OF THE INVENTION

It is therefore an object of the present invention to provide an improved photoresponsive member which overcomes the above-noted disadvantages.

It is yet another object of the present invention to provide an improved photoresponsive device which is panchromatic and thus sensitive to visible light as well as infra-red light.

A further specific object of the present invention is the provision of an improved overcoated photoresponsive device containing a photoconductive composition situated between a hole transport layer and a photogenerating layer.

It is yet another object of the present invention to provide an improved overcoated photoresponsive device containing a photogenerating layer in contact with a hole transport layer, with the photoconductive composition being coated on the photogenerating layer.

Another object of the present invention resides in the provision of an improved overcoated photoresponsive device containing a photoconductive composition situated between a hole transport layer and a photogenerating layer, which device is simultaneously responsive to infra-red light and visible light, and wherein the device has improved adhesion properties.

In yet another object of the present invention there is provided imaging and printing methods utilizing the improved overcoated photoresponsive device of the present invention.

In another object of the present invention there is provided a photoresponsive device containing a photoconductive composition situated between a hole transport layer and a photogenerating layer, and a top protectant overcoating layer, which layer may also function as a hole blocking medium.

These and other objects of the present invention are accomplished by the provision of an improved photoresponsive device comprising a layer of a photoconductive composition situated between a photogenerating layer and a hole transport layer, or wherein the photoconductive layer is overcoated on the photogenerating layer which is in contact with the hole transport layer. The improved photoresponsive device of the present invention thus contains a photoconductive composition layer which serves to enhance or reduce the intrinsic properties of the photogenerating layer in the infra-red and/or visible range of the spectrum. Moreover the photoresponsive device of the present invention can contain a top overcoating protective layer.

In one specific embodiment, the present invention is directed to an improved photoresponsive device comprised in the order stated of (1) a substrate, (2) an adhesive interface layer, (3) a hole transport layer, (4) a composition capable of enhancing or reducing the intrinsic properties of the photogenerating layer, which composition is selected from the group consisting of organic photoconductive materials, charge transfer complex materials, and sensitizers, (5) a photogenerating layer, and (6) an optional top overcoating layer. In one important embodiment of the present invention, the photoresponsive device is comprised of a conductive substrate, an adhesive layer, a hole transport layer comprised of certain diamines dispersed in a resinous matrix, a composition capable of enhancing or reducing the intrinsic properties of the photogenerating layer, which composition is comprised of a photoconductive material containing organic photoconductive substances, charge transfer complexes, sensitizers, or mixtures thereof, and a photogenerating material comprised of inorganic photoconductive substances, overcoated on the transport layer. It is important in one feature of the present invention that the photoconductive layer in contact with the hole transport layer be capable of allowing holes generated by the photogenerating layer to be transported, and further this layer should not trap the holes and should possess transmission properties that allows passage of the light required to produce electron hole pairs in the photogenerating layer. Alternatively, the photoconductive layer can be used as a selective filter, allowing light of a certain wavelength to penetrate to the photogenerating layer.

The device of the present invention may also in one embodiment contain a polymeric top overcoating protective layer. This layer functions for example as an abrasion resistant layer, and serves to protect the device from corona effluents and the like. Also this layer may also function as a hole blocking layer in that charges deposited on the polymer overcoating will not dark decay by surface injection and collapse the electric field across the device, or parts thereof.

In another important embodiment, the present invention is directed to an improved photoresponsive device as described hereinbefore, with the exception that the composition capable of enhancing or reducing the intrinsic properties of the photogenerating layer is coated on the photogenerating layer. Accordingly, in this variation, the photoresponsive device of the present invention contains a photoconductive layer comprising a composition capable of enhancing or reducing the intrinsic properties of the photogenerating layer in contact with and coated on top of the photogenerating layer. In this embodiment of the present invention, the layer capable of enhancing or reducing the intrinsic properties of the photogenerating layer, which layer is comprised of a photoconductive material containing organic photoconductive substances, charge transfer complexes, sensitizers, and/or mixtures thereof is situated above the photogenerating layer which has been coated on top of the hole transport layer. An optional polymeric overcoating top may also be applied to this device.

The improved photoresponsive devices of the present invention can be made by a number of known methods, the process parameters and the order of the coating of the layers being dependent on the device desired. Thus, for example, the improved photoresponsive device of the present invention can be prepared by providing a conductive substrate containing an adhesive layer, and applying thereto by solvent coating processes, laminating processes, or other methods, a hole transport layer, a composition capable of enhancing or reducing the intrinsic properties of the photogenerating layer and a photogenerating layer.

The improved photoresponsive device of the present invention can be selected for use in various imaging systems, and more importantly can function simultaneously in imaging and printing systems utilizing visible light or infra-red light. Thus the improved photoresponsive device of the present invention may be positively charged, exposed to light in the wavelength range of from about 400 to about 1,000 nanometers either sequentially or simultaneously, followed by developing the image, and transferring. The above sequence may be repeated many times.

Exposure to illumination and erasure, of the photoresponsive devices of the present invention may be accomplished from the rearside, from the frontside, or combinations thereof.

BRIEF DESCRIPTION OF THE DRAWINGS

For a better understanding of the present invention and further features thereof, reference is made to the following detailed description of various preferred embodiments wherein.

The percent discharge is defined as follows $$\frac{V_{DDP}(800\text{ volts}) - V\ 5\text{ Ergs cm-2}}{V_{DDP}(800\text{ volts})} \times 100$$

wherein $V_{DDP}$ is the dark development potential, and V(volts) 5 Ergs cm-2 is the surface potential in volts on the photoreceptor after exposure to 5 Ergs cm-2 of light in the wavelength range 400 to 1,000 nanometers.

As an example, for a $V_{DDP}$ of 800 volts and a surface potential of 400 volts, after 5 ergs cm-2 exposure at, for example 800 nm, the percent discharge would be 50 percent.

DESCRIPTION OF THE PREFERRED EMBODIMENTS

Figure 1:
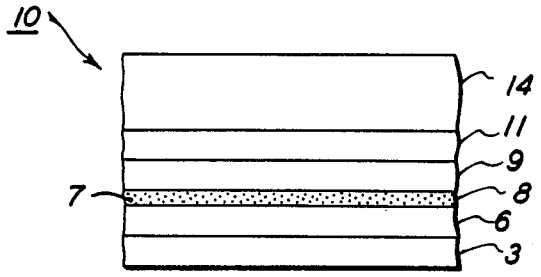
FIG. 1 is partially schematic cross-sectional view of the improved photoresponsive device of the present invention.

Illustrated in FIG. 1 is the improved photoresponsive device of the present invention, generally designated 10, and comprising a substrate 3, an optional adhesive layer 6, a charge carrier transport layer 8, a charge carrier photogenerating layer 9, a composition capable of enhancing or reducing the intrinsic properties of the photogenerating layer 9, this composition being referred to herein as photoconductive layer 11 and optional top overcoating polymeric layer 14.

Figure 2:
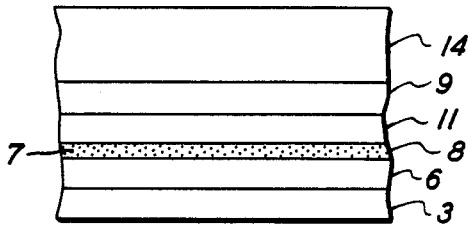
FIG. 2 is a partially schematic cross-sectional view of a preferred photoresponsive device of a present invention.

Illustrated in FIG. 2 is essentially the same device as illustrated in FIG. 1 with the exception that the photoconductive layer 11 is situated between the hole transport layer 8, and the photogenerating layer 9.

The substrate layer 3 may be opaque or substantially transparent and may comprise any suitable material having the requisite mechanical properties. Thus, the substrate may comprise a layer of insulating materials such as an inorganic or organic polymeric material a layer of organic or inorganic material having a semiconductive surface layer such as indium tin oxide arranged thereon, or a conductive material such as, for example, aluminum, chromium, nickel, brass or the like. The substrate may be flexible or rigid and many have any of many different configurations such as, for example, a plate, a cylindrical drum, a scroll, an endless flexible belt and the like. Preferably, the substrate is in the form of an endless flexible belt. In some situations it may be desirable to coat on the back of the substrate, particularly when the substrate is an organic polymeric material, an anti-curl layer, such as for example, polycarbonate materials, commercially available as Makrolon.

The thickness of the substrate layer depends on many factors, including economical considerations, thus this layer may be of substantial thickness, for example, over 100 mils or minimum thickness providing there are no adverse effects on the resulting device. In one preferred embodiment the thickness of this layer ranges from about 3 mils to about 10 mils.

Adhesive layer 6, is typically a polymeric composition, such as polyvinylbutyral, polyvinylpyrrolidone, polyesters, and the like. Typically this layer is of a thickness of less than about 0.3 microns.

Charge carrier transport layer 8 can be comprised of a number of numerous suitable materials which are capable of transporting holes, this layer generally having a thickness in the range of from about 5 microns to about 50 microns, and preferably from about 20 microns to about 40 microns. In a preferred embodiment this transport layer comprises molecules of the formula:

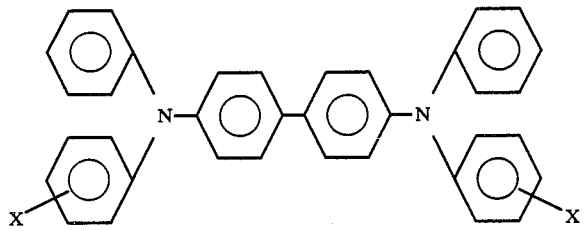

dispersed in a highly insulating and transparent organic resinous binder, 7, wherein X is selected from the group consisting of (ortho) $CH_3$, (meta) $CH_3$, (para) $CH_3$, (ortho) Cl, (meta) Cl, (para) Cl. The highly insulating resin, which has a resistivity of at least $10^{12}$ ohm-cm to prevent undue dark decay, is a material which is not necessarily capable of supporting the injection of holes from the photogenerating layer, and is not capable of allowing the transport of these holes through the material. However, the resin becomes electrically active when it contains from about 10 to 75 weight percent of the substituted N,N,N',N'-tetraphenyl[1,1-biphenyl]4,4'-diamines corresponding to the foregoing formula.

Compounds corresponding to the above formula include, for example, N,N'-diphenyl-N,N'-bis(alkylphenyl)-[1,1-biphenyl]-4,4'-diamine wherein alkyl is selected from the group consisting of methyl such as 2-methyl, 3-methyl and 4-methyl, ethyl, propyl, butyl, hexyl and the like. With halo substitution, the amine is named N,N'-diphenyl-N,N'-bis(halo phenyl)-[1,1'-biphenyl]-4,4'-diamine, wherein the halo atom is 2-chloro, 3-chloro or 4-chloro.

Other electrically active small molecules which can be dispersed in the electrically inactive resin to form a layer which will transport holes include, bis(4-diethylamine-2-methylphenyl)phenylmethane; 4',4''-bis(diethylamino)-2'2''-dimethyltriphenyl methane; bis-4(diethylamino phenyl)phenylmethane; and 4,4'-bis(diethylamino)-2,2'-dimethyl triphenylmethane. Providing the objectives of the present invention are achieved, other charge carrier transport molecules can be selected for layer 8.

Examples of the highly insulating and transparent resinous material or inactive binder resinous material, for layer 8, include substances such as those described in U.S. Pat. No. 3,121,006, the disclosure of which is totally incorporated herein by reference. Specific examples of organic resinous materials include polycarbonates, acrylate polymers, vinyl polymers, cellulose polymers, polyesters, polysiloxanes, polyamides, polyurethanes and epoxies, as well as block, random or alternating copolymers thereof. Preferred electrically inactive binder materials are polycarbonate resins having a molecular weight (Mw) of from about 20,000 to about 100,000 with a molecular weight in the range of from about 50,000 to about 100,000 being particularly preferred. Generally, the resinous binder contains from about 10 to about 75 percent by weight of the active material corresponding to the foregoing formula, and preferably from about 35 percent to about 50 percent of this material.

The inorganic photogenerating layer 9 can be comprised of known photoconductive charge carrier generating materials, sensitive to visible light, such as amorphous selenium, amorphous selenium alloys, halogen doped amorphous selenium, halogen doped amorphous selenium alloys, trigonal selenium, mixtures of Groups IA and IIA elements, selenite and carbonates with trigonal selenium, reference U.S. Pat. Nos. 4,232,102 and 4,233,283 copper, and chlorine doped cadmium sulphide, cadmium selenide and cadmium sulphur selenide cadmium sulpho telluride, cadmium selnotelluride, and the like. Alloys of selenium included with in the scope of the present invention include selenium tellurium alloys, selenium arsenic alloys, selenium tellurium arsenic alloys, and preferably such alloys containing a halogen material such as chlorine in an amount of from about 50 to about 200 parts per million.

Layer 9 typically, has a thickness of from about 0.05 microns to about 10 microns or more and is preferably from about 0.4 microns to about 3 microns in thickness, however, the thickness of this layer is primarily dependent on the photoconductor volume loading, which may vary from 5 to 100 volume percent. Generally, it is desirable to provide this layer in a thickness which is sufficient to absorb about 90 percent or more of the incident radiation which is directed upon it in the imagewise or printing exposure step. Also the maximum thickness of this layer is dependent primarily upon factors such as mechanical considerations, for example whether a flexible photoresponsive device is desired.

The photoconductive layer 11 may be comprised of numerous organic photoconductive substances, charge transfer complexes, squarylium pigments, various sensitizers, mixtures thereof and the like. Illustrative examples of materials useful in this layer include metal phthalocyanines, metal free phthalocyanines, vanadyl phthalocyanines, other known phthalocyanines, as disclosed in U.S. Pat. No. 3,816,118, the disclosure of which is totally incorporated herein by reference, squarylium pigments, charge transfer complex materials such as polyvinyl carbazoletrinitrofluoronone, particularly polyvinyl carbazole 2,4,7-trinitrofluoronone, and various infra-red sensitizers, such as cyanine dyes, described in the Chemistry of Synethtic Dyes, Volume II and Volume IV, 1971, Academic Press, edited by K. Venkataraman.

Specific illustrative examples of squarylium pigments that can be selected for layer 11 include, for example, those of the following formula

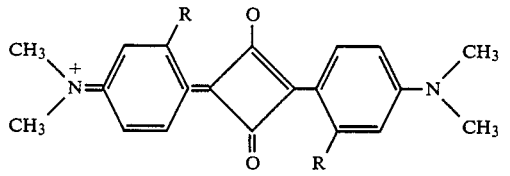

wherein R is hydrogen, an alkyl group such as methyl, or a hydroxy (OH) group.

The materials selected for layer 11, reference FIG. 2, must be electronically compatible with the charge carrier transport layer 8, in order that photoexcited charge carriers can be injected into the transport layer, and further, in order that charge carriers can travel in both directions across the interface between the photoconductive layer 11, and the charge transport layer 8. One preferred material for layer 11 that accomplishes these functions is vanadyl phthalocyanine, primarily since it is readily available, and provides the desired level of enhancement of the intrinsic properties of the photogenerating layer, in the infra-red range of the spectrum, about 700 nanometers to about 920 nanometers.

Generally, the thickness of layer 11 depends on a number of factors including the thicknesses of the other layers, and the percent mixture of photoconductive material contained in this layer. Accordingly, this layer can range in thickness of from about 0.05 microns to about 10 microns when a photoconductive composition such as vanadyl phthalocyanine is present in an amount of from about 5 percent to about 100 percent by volume, and preferably this layer ranges in thickness of from about 0.25 microns to about 1 micron, when the photoconductive composition such as vanadyl phthalocyanine is present in this layer in an amount of 30 percent by volume. The maximum thickness of this layer is dependent primarily upon factors such as mechanical considerations, for example whether a flexible photoresponsive device is desired.

The inorganic photogenerating materials for layer 9, or the photoconductive materials for layer 11, can comprise 100 percent of the respective layers, or these materials can be dispersed in various suitable inorganic or resinous polymer binder materials, in amounts of from about 5 percent by volume to about 95 percent by volume, and preferably in amounts of from about 25 percent by volume to about 75 percent by volume. Illustrative examples of polymeric binder resinous materials that can be selected include those as disclosed, for example, in U.S. Pat. No. 3,121,006, the disclosure of which is totally incorporated herein by reference, polyesters, polyvinyl butyral, Formvar®, polycarbonate resins, polyvinyl carbazole, epoxy resins, and phenoxy resins, especially the commercially available poly(hydroxyether) resins.

Examples of top overcoating layer 14 include those as described in U.S. Pat. No. 3,121,006, the disclosure of which is totally incorporated herein by reference, including polyesters, polyvinylbutyral, Formvar®, polycarbonate resins, polyvinylcarbazole, epoxy resins, phenoxy resins, especially the commercially available poly(hydroxyether) resins, and mixtures thereof. The overcoating layer can be of various thickness depending for example on the thickness of the other layers, generally however this layer ranges in thickness of from about 0.1 microns to about 5 microns. When thicker overcoating layers are used, that is from about 6 microns to about 50 microns a hole injecting layer such as gold, or graphite, is situated between the substrate and the hole transport layer, while a hole trapping layer such as an amine is situated between for example the photoconductive layer and the overcoating layer.

In one embodiment of the present invention, the charge carrier transport material, such as the diamine described hereinafter, may be incorporated into layer 9, and/or layer 11, in amounts for example, ranging from about zero volume percent to 60 volume percent.

Figure 3:
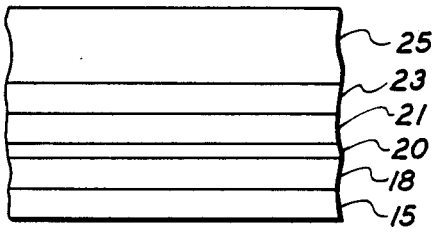
FIG. 3 illustrates a further preferred embodiment of the photoresponsive device of the present invention.

Illustrated in FIG. 3 is one preferred photoresponsive device of the present invention wherein the substrate 15 is comprised of Mylar in a thickness of 3 mils, containing a layer of 20 percent transmissive aluminum in a thickness of about 100 Angstroms, layer 18 is a polyester adhesive interface commercially available from E. I. duPont, as 49,000 polyester in a thickness of about 0.05 microns, the hole transport layer 20, thickness about 25 microns is comprised of 50 weight percent N,N-diphenyl-N,N'-bis(3-methylphenyl)-[1,1'-biphenyl]-4,4'-diamine, dispersed in a polycarbonate resinous binder, the photoconductive layer 21 has a thickness of about 0.5 microns, and is comprised of 30 volume percent vanadyl phthalocyanine dispersed in a polyester binder, 70 volume percent the inorganic photogenerating layer 23 is of a thickness of about 2.0 microns and is comprised of 10 volume percent $Na_2SeO_3$ and $Na_2CO_3$ doped trigonal selenium in a polyvinyl carbazole binder, and a top overcoating layer 24 of polyvinylbutyral in a thickness of 0.5 microns.

Figure 4:
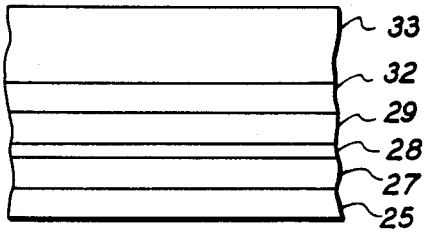
FIG. 4 illustrates another preferred embodiment of the photoresponsive device of the present invention.

Illustrated in FIG. 4 is another preferred photoresponsive device of the present invention, wherein layers 25, 27, 28, 29, 32 and 33 are identical to layers 15, 18, 20, 21 and 23, and 25 as described with reference to FIG. 3. In FIG. 4, the photoconductive layer 29, rather than being vanadyl phthalocyanine, is comprised of about 30 volume percent of hydroxy squarylium dispersed in resinous binder material, 70 volume percent commercially available as Formvar® from Monsanto Chemical Company.

Figure 5:
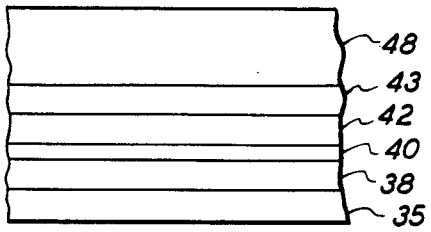
FIG. 5 illustrates another preferred embodiment of the photoresponsive device of the present invention.

There is illustrated in FIG. 5 a further embodiment of the photoresponsive device of the present invention, wherein the substrate 35, is comprised of Mylar in a thickness of 3 mils, containing about a 100 Angstrom layer of 20 percent transmissive aluminum, the adhesive layer 38 is a polyester material commercially available from E. I. duPont Company, as duPont 49,000, this layer having a thickness of about 0.05 microns, a hole transport layer 40, in a thickness of 25 microns, comprised of 50 percent by weight of N,N'-diphenyl-N,N'-bis(3-methylphenyl)-[1,1'-butenyl]-4,4'-diamine, dispersed in a polycarbonate resinous binder, a photoconductive layer 42, comprised of 30 percent by volume of vanadyl phthalocyanine dispersed in a polyester binder, which layer has a thickness of about 0.5 microns, or 30 volume percent of hydroxy squarylium, 0.5 microns in thickness dispersed in the resinous binder Formvar®, a photogenerating layer 43 comprised of 33 percent by volume of trigonal selenium dispersed in a phenoxy resinous binder, commercially available as the poly(hydroxyether) Bakelite from Allied Chemical Corporation, this layer having a thickness of 0.4 microns, and top overcoating layer 48, of polyvinylbutyral in a thickness of 0.5 microns.

In alternative prefered embodiments with respect to the above figures the vanadyl phthalocyanine photoconductive layer is situated on top of the inorganic trigonal selenium photogenerating layer, which layer is in contact with the amine charge transport layer.

The invention will now be described in detail with respect to specific preferred embodiments thereof, it being understood that these examples are intended to be illustrative only, and the invention is not intended to be limited to the materials, conditions, or process parameters, recited herein. All parts and percentages are by weight unless otherwise indicated. Examples III to VII relate to the preparation of comparative prior art photoresponsive devices.

EXAMPLE I

Preparation of N,N-diphenyl-N,N'-bis(3-methylphenyl)-[1,1'-biphenyl]-4,4'-diamine In a 5,000 milliliter (ml), round bottom 3, necked flask fitted with a mechanical stirrer and blanketed with argon, is placed 336 grams (1 mole) of N,N'-diphenyl[1,1'-biphenyl]-4,4'-diamine, 550 grams (2.5 moles) of m-iodotoluene, 550 grams (4 moles) potassium carbonate (anhydrous), 50 grams of a copper bronze catalyst, and 1,500 ml dimethylsulfoxide (anhydrous). The heterogeneous mixture is refluxed for 6 days. The mixture is allowed to cool, and 200 ml of benzene is added. The dark slurry is then filtered. The filtrate is extracted 4 times with water. Then the filtrate is dried with magnesium sulfate and filtered. The benzene is taken off under reduced pressure. The black product is column chromatographed using Woelm neutral alumina. Colorless crystals of the above diame product are obtained by recrystallizing the product from n-octane. The melting point is 167°–169° C. The yield is 360 grams (65 percent).

Analytical Calculation for $C_{38}H_{32}N_2$: C, 88.34; H, 6.24; N, 5.37. Found: C, 88.58; H, 6.21; N, 5.37.

EXAMPLE II

Preparation of N,N-diphenyl-N,N'-bis(4-methylphenyl)-[1,1'-biphenyl]-4,4'-diamine In a 500 milliliter, round bottom flask, equipped with a magnetic stirrer and purged with argon, is charged with 20 grams of p,p-diiodobiphenyl (0.05 mole), 18.3 grams of p-tolylphenyl-amine (0.1 mole), 20.7 grams potassium carbonate (anhydrous) (0.15 mole) 3.0 grams of copper powder and 50 mils of sulfolane (tetrahydrothiophene-1,1-dioxide). The mixture is heated to 220°–225° C. for 24 hours, allowed to cool to approximately 150° C. and 300 milliliters of deionized water are added. The heterogeneous mixture is heated to reflux while vigorously stirring. A light tan oily precipitate is formed in the flask. The water is then decanted. Then 300 milliliters of water are added, and the water layer was again decanted. 300 milliliters of methanol was added and the mixture was refluxed to dissolve any unreacted starting materials. The solids were filtered off, added to 300 milliliters of n-octane and heated to a reflux temperature of 125° C. The solution was filtered through 100 grams of neutral Woelm alumina to give a pale yellow filtrate. The solution was again filtered through 100 grams of neutral Woelm alumina to yield a colorless filtrate and was allowed to cool yielding colorless crystals of the intended compound having a M.P. of 163°–164° C.

Analytical Calculation for $C_{38}H_{32}N_2$: C, 88.34; H, 6.24; N, 5.37. Found: C, 88.49; H, 6.44; N, 5.28.

EXAMPLE III

A photoreceptive device was prepared by providing an aluminized Mylar substrate in a thickness of 3 mils, and applying thereto, wet thickness, 0.5 mils, a layer of 0.5 weight percent duPont 49,000 adhesive, a polyester available from E. I. duPont, in methylene chloride and 1,1,2-trichloroethane (4:1 volume ratio) with a Bird applicator. This layer was allowed to dry for one minute at room temperature, and 10 minutes at 100° C. in a forced air oven, resulting in a layer having a dry thickness of about 0.05 microns.

There was then coated on the adhesive layer a charge transport layer which was prepared as follows.

A transport layer containing 50 percent by weight of Makrolon ®, a polycarbonate resin having a molecular weight ($M_w$) of from about 50,000 to about 100,000, commercially available from Larbensabricken Bayer A.G., was mixed with 50 percent by weight of N,N'-diphenyl-N,N'-bis(3-methylphenyl)1,1'-biphenyl-4,4'-diamine. The resulting solution was then mixed in 15 percent of weight of methylene chloride. All of the above components were then placed into an amber bottle and dissolved. The mixture was coated to a dry 25 micron thickness layer on top of the adhesive layer using a Bird applicator. During this coating process the humidity was equal to or less than 15 percent. The resulting device containing all of the above layers was annealed at 135° C. in a forced air oven for 6 minutes.

There was then overcoated on the transport layer 10 volume percent of a photogenerating layer comprised of trigonal selenium prepared as follows.

In a 2 oz. amber bottle there was added 0.8 grams polyvinyl carbazole and 14 milliliters, 1:1 volume ratio, tetrahydrofuran and toluene. There was then added to this solution 0.8 grams of trigonal selenium, and 100 grams of stainless steel shot, ⅛" in diameter. The above mixture was then placed on a ball mill for 72 to 96 hours. Subsequently, 5 grams of the resulting slurry were added to a solution of 0.18 grams of polyvinyl carbazole, and 0.15 grams of N,N'-diphenyl-N,N'-bis(3-methylphenyl)1,1'-biphenyl-4,4'-diamine, in 6.3 milliliters of tetrahydrofuran-toluene, volume ratio 1:1. This slurry was then placed on a shaker for 10 minutes. The resulting slurry was then coated on the above transport layer interface with a Bird applicator, wet thickness 0.5 mils. This layer was then dried at 130° C. for 6 minutes in a forced air oven, resulting in a dry thickness of 2.0 microns. The resulting layer contained 10 volume percent of trigonal selenium and 25 volume percent of the diamine, and 65 volume percent of polyvinyl carbazole.

EXAMPLE IV

A photoreceptive device was prepared by providing an aluminized Mylar substrate in a thickness of 3 mils, and applying thereto in a wet thickness of 0.5 mils, a layer of 0.5 weight percent of duPont 49,000 adhesive, a polyester available from E. I. duPont, in methylene chloride and 1,1,2-trichloroethane (4:1 volume ratio) with a Bird applicator. This layer was then allowed to dry for one minute at room temperature and 10 minutes at 100° C. in a forced air oven. The resulting layer had a dry thickness of 0.05 microns.

The above adhesive layer was then overcoated with a charge transport layer which was prepared as follows.

A transport layer containing 50 percent by weight Makrolon ®, a polycarbonate resin having a molecular weight ($M_w$) of from about 50,000 to about 100,000 available from Larbensabricken Bayer A.G., was mixed with 50 percent by weight of N,N'-diphenyl-N,N'-bis(3-methylphenyl)1,1'-biphenyl-4,4'-diamine. The resulting was then mixed in 15 percent by weight methylene chloride. All of the above components were then placed into an amber bottle and dissolved. The mixture was then coated to a dry 25 micron thickness layer on top of the adhesive layer using a Bird applicator. During this coating process, the humidity was equal to or less than 15 percent. The resulting device was then dried in a force air oven for six minutes at 135 degrees centigrade.

There was then overcoated on the above transport layer, in the following manner a photogenerating layer, thickness 0.5 microns, containing 30 volume percent of a trigonal selenium, 25 volume percent N,N'-diphenyl-N,N'-bis(3-methylphenyl)1,1'-biphenyl-4,4'-diamine and 45 volume percent of polyvinyl carbazole prepared as follows: The resulting device containing all of the above layers was annealed at 135° C. in a forced air oven for 6 minutes.

In a 2 oz. amber bottle was added 0.8 grams polyvinyl carbazole, and 18 milliliters, 1:1 by volume, tetrahydrofuran/toluene. Added to this solution was 2.1 grams of trigonal selenium, and 100 grams of stainless steel shot, ⅛" in diameter. The above mixture was then placed on a ball mill for 72 to 96 hours, resulting in a slurry. In a 1 oz. amber bottle was added 0.04 grams N,N'-diphenyl-N,N'-bis(3-methylphenyl)1,1'-biphenyl-4,4'-diamine, and 6.4 milliliters of tetrahydrofuran/toluene. Added to this solution was 2 grams of the ball milled slurry. The resulting mixture was then placed on a shaker to 10 minutes, and the slurry formed was then coated on the above transport layer with a Bird applicator, at a wet thickness 0.5 mils. This device was then dried at 135° C. for 6 minutes in a forced air oven.

EXAMPLE V

A photoreceptive device was prepared by providing an aluminized Mylar substrate in a thickness of 3 mils, and applying thereto in a wet thickness of 0.5 mils, a layer of 0.5 percent by weight of duPont 49,000 adhesive, a polyester available from duPont, in methylene chloride and 1,1,2-trichloroethane (4:1 volume ratio) with a Bird applicator. The wet thickness was 0.5 mil. This layer was then allowed to dry for one minute at room temperature and 10 minutes at 100° C. in a forced air oven. The resulting layer had a dry thickness of about 0.05 microns.

The above adhesive layer was then overcoated with a charge transport layer which was prepared as follows.

A transport layer containing 50 percent by weight Makrolon ®, a polycarbonate resin having a molecular weight ($M_w$) of from about 50,000 to about 100,000 available from Larbensabricken Bayer A.G., was mixed with 50 percent by weight N,N'-diphenyl-N,N'-bis(3-methylphenyl)1,1'-biphenyl-4,4'-diamine. The resulting solution was then mixed in 15 percent by weight of methylene chloride. All of the above components were then placed into an amber bottle and dissolved. The mixture was coated to a dry 25 micron thickness layer on top of the adhesive layer using a Bird applicator. During the coating process the humidity was equal to or less than 15 percent. The resulting device was then dried in a forced air oven for 6 minutes at 135 degrees centigrade.

A photogenerator layer containing 33 percent by volume of trigonal selenium, and 13 percent by volume of N,N'-diphenyl-N,N'-bis(3-methylphenyl)1,1'-biphenyl-4,4'-diamine dispersed in 54 percent of the phenoxy resinous binder available from Union Carbide as Bakelite PHKK was prepared as follows.

In a 4 oz. amber bottle was added 1.6 grams of the above phenoxy resin and 0.4 grams N,N'-diphenyl-N,N'-bis(3-methylphenyl)1,1'-biphenyl-4,4'-diamine, in 21 milliliters of methyl ethyl ketone and 7 milliliters methoxyethyl acetate (cellosolve acetate). Added to this solution was 3.2 grams of trigonal selenium, and 200 grams of stainless steel shot, ⅛" in diameter. The above mixture was then placed on a ball mill for 72 to 96 hours. The slurry was then coated on the above transport layer with a Bird applicator, in a wet thickness 0.5 mils. This device was then dried at 135° C. for 6 minutes in a forced air oven. The dry thickness of the photogenerating layer was 0.5 microns.

EXAMPLE VI

A photoreceptive device was prepared by providing an aluminized Mylar substrate in a thickness of 3 mils, and applying thereto a layer of 0.5 percent by weight of duPont 49,000 adhesive, in methylene chloride and 1,1,2-trichloroethane 4:1 volume with a Bird Applicator. The layer was allowed to dry for one minute at room temperature, and 10 minutes at 100° C. in a forced air oven. The dry thickness of the resulting layer was 0.05 microns.

The above adhesive layer was then overcoated with a charge transport layer which was prepared as follows.

A transport layer containing 50 percent by weight Makrolon ®, a polycarbonate resin having a molecular weight ($M_w$) of from about 50,000 to about 100,000 available from Larbensabricken Bayer A.G., was mixed with 50 percent by weight N,N'-diphenyl-N,N'-bis(-3methylphenyl)1,1'-biphenyl-4,4'-diamine. This solution was then mixed in 15 percent by weight of methylene chloride. All of these components were placed into an amber bottle and dissolved. The mixture was coated to a dry 25 micron thickness layer on top of the adhesive layer using a Bird applicator. During this coating process humidity was equal to or less than 15 percent. This device was then dried in a forced air oven for 6 minutes at 135 degrees centigrade.

A photoconductive layer containing 30 percent by volume of vanadyl phthalocyanine was then prepared as follows.

In a 2 oz. amber bottle was added 0.76 grams of duPont 49,000 polyester in 16 milliliters methylene chloride. Added to this solution was 0.36 grams of vanadyl phthalocyanine, and 100 grams ⅛" stainless steel shot. The above mixture was placed on a ball mill for 24 hours. To 5 grams of this slurry was added 10 milliliters of methylene chloride. This slurry is coated on the above transport layer with a Bird applicator, to a wet thickness of 0.5 mils. This layer was allowed to air dry for 5 minutes. This device was dried at 135° C. for 6 minutes in a forced air oven. The dry thickness was 0.5 microns.

EXAMPLE VII

A photoreceptive device was prepared by providing an aluminized Mylar substrate in a thickness of 3 mils, and applying thereto in a wet thickness of 0.5 mils, a layer of 0.5 percent weight of duPont 49,000 polyester adhesive, in methylene chloride and 1,1,2-trichloroethane (4:1 volume ratio) with a Bird Applicator. The layer was allowed to dry for one minute at room temperature, and 10 minutes at 100° C. in a forced air oven. The resulting layer had a dry thickness of 0.05 microns.

The above adhesive layer was overcoated with a charge transport layer which was prepared as follows.

A transport layer containing 50 percent by weight Makrolon®, a polycarbonate resin having a molecular weight ($M_w$) of from about 50,000 to about 100,000 available from Larbensabricken Bayer A.G., was mixed with 50 percent by weight N,N'-diphenyl-N,N'-bis(3-methylphenyl)1,1'-biphenyl-4,4'-diamine. This solution was mixed in 15 percent by weight of methylene chloride. All of these components were placed into an amber bottle and dissolved. The mixture was coated to a dry 25 micron thickness layer on top of the adhesive layer using a Bird applicator. During this coating process humidity was equal to or less than 15 percent. The resulting device containing all of the above layers was annealed at 135° C. in a forced air oven for 6 minutes.

A photoconductive layer containing 30 percent by volume of hydroxy squarylium was then prepared as follows.

In a 2 oz. amber bottle was added 0.76 grams Formvar 12/85, commercially available from Monsanto Chemical Company and 16 milliliters of tetrahydrofuran. Added to this solution was 0.36 grams of hydroxy squarylium, and 100 grams ⅛" stainless steel shot. The above mixture was placed on a ball mill for 24 hours. To 5 grams of this slurry was added 10 milliliters of tetrahydrofuran. This slurry was then coated on the above transport layer with a Bird applicator, to a wet thickness of 0.5 mils. The resulting layer was allowed to air dry for 5 minutes. This device was dried at 135° C. for 6 minutes in a forced air oven. The dry thickness of the photoconductive layer was 0.5 microns.

EXAMPLE VIII

A photoreceptive device was prepared by providing an aluminized Mylar substrate in a thickness of 3 mils and applying thereto in a wet thickness of 0.5 mils, a layer of 0.5 percent weight of duPont 49,000 adhesive, in methylene chloride and 1,1,2-trichloroethane 4:1 volume with a Bird Applicator. The layer was allowed to dry for one minute at room temperature and 10 minutes at 100° C. in a forced air oven. The resulting layer had a dry thickness of 0.05 microns.

The above adhesive layer was overcoated with a charge transport layer which was prepared as follows.

A transport layer containing 50 percent by weight Makrolon$^R$, a polycarbonate resin having a molecular weight ($M_w$) of from about 50,000 to about 100,000 available from Larbensabricken Bayer A.G., was mixed with 50 percent by weight of N,N'-diphenyl-N,N'-bis(3-methylphenyl)1,1'-biphenyl-4,4'-diamine. This solution was mixed in 15 percent by weight of methylene chloride. All of these components were placed into an amber bottle and dissolved. The mixture was coated to a dry 25 micron thickness layer on top of the adhesive layer using a Bird applicator. During this coating process the humidity was equal to or less than 15 percent. This device was then dried at 135 degrees centigrade for 6 minutes in a forced air oven.

A photoconductive layer containing 30 percent by volume vanadyl phthalocyanine was then prepared as follows.

In a 2 oz. amber bottle was added 0.76 grams of duPont 49,000 in 16 milliliters methylene chloride. Added to this solution was 0.36 grams of vanadyl phthalocyanine and 100 grams ⅛" stainless steel shot. The above mixture was placed on a ball mill for 24 hours. To 5 grams of this slurry was added 10 milliliters of methylene chloride. This slurry was then coated on the above transport layer with a Bird applicator to a wet thickness of 0.5 mil. This layer was allowed to air dry 1–5 minutes to a dry thickness of 0.5 microns. The resulting device was dried at 135° C. for 6 minutes in a forced air oven.

A photogenerator layer containing 10 volume percent of trigonal selenium, 25 percent by volume N,N'-diphenyl-N,N'-bis(3-methylphenyl)1,1'-biphenyl-4,4'-diamine and 65 volume percent of polyvinyl carbazole was then prepared as follows.

In a 2 oz. amber bottle was added 0.8 grams polyvinyl carbazole and 14 milliliters 1:1 by volume tetrahydrofuran/toluene. Added to this solution was 0.8 grams of trigonal selenium and 100 grams of ⅛" stainless steel shot. The above mixture was placed on a ball mill for 72.96 hours. Five grams of this slurry was added to a solution of 0.18 grams of polyvinyl carbazole and 0.15 grams N,N'-bis(3-methylphenyl)1,1'-biphenyl-4,4'-diamine in 6.3 milliliters of tetrahydrofuran/toluene. This mixture was placed on a shaker for 10 minutes. The slurry was then coated on the above photoconductive layer with a Bird applicator. The wet thickness was 0.5 mils. This layer was dried at 135° C. for 6 minutes in a forced air oven. The dry thickness was 2.0 microns.

EXAMPLE IX

A photoreceptive device was prepared by providing an aluminized Mylar substrate in a thickness of 3 mils, and applying thereto in a wet thickness of 0.5 mils a layer of 0.5 percent weight of duPont 49,000 polyester adhesive, in methylene chloride and 1,1,2-trichloroethane (4:1 volume ratio) with a Bird Applicator. The layer was allowed to dry for one minute at room temperature, and 10 minutes at 100° C. in a forced air oven. The resulting layer had a dry thickness of 0.05 microns.

The above adhesive layer was then overcoated with a charge transport layer which was prepared as follows.

A transport layer containing 50 percent by weight Makrolon$^R$, a polycarbonate resin having a molecular weight ($M_w$) of from about 50,000 to about 100,000 available from Larbensabricken Bayer A.G., was mixed with 50 percent by weight N,N'-diphenyl-N,N'-bis(3-methylphenyl)1,1'-biphenyl-4,4'-diamine. This solution was mixed in 15 percent by weight of methylene oxide. All of these components were then placed into an amber bottle and dissolved. The mixture was coated to a dry 25 micron thickness layer on top of the adhesive layer using a Bird applicator. During this coating process the humidity was equal to or less than 15 percent. This layer was dried at 135 degrees centigrade for 6 minutes in a forced air oven.

A photoconductive layer containing 30 percent by volume of vanadyl phthalocyanine was then prepared as follows.

In a 2 oz. amber bottle was added 0.76 grams of duPont 49,000 polyester in 16 milliliters of methylene chloride. Added to this solution was 0.36 grams of vanadyl phthalocyanine, and 100 grams of ⅛" stainless steel shot. The above mixture was the placed on a ball mill for 24 hours. To 5 grams of the resulting slurry there was added 10 milliliters of methylene chloride. The slurry was then coated on the above transport layer with a Bird applicator, to a wet thickness of 0.5 mils. The layer was then allowed to air dry for 5 minutes to a dry thickness of 0.5 microns. The resulting layer was then dried at 135° C. for 6 minutes in a forced air oven.

A photogenerator layer containing 30 percent by volume of trigonal selenium and 25 percent by volume of N,N'-diphenyl-N,N'-bis(3-methylphenyl)1,1'-biphenyl-4,4'-diamine was then prepared as follows.

In a 2 oz. amber bottle was added 0.8 grams polyvinyl carbazole, and 18 milliliters, 1:1 by volume, tetrahydrofuran/toluene. Added to this solution was 2.1 grams of trigonal selenium, and 100 grams of stainless steel shot, ⅛" in diameter. The above mixture was then placed on a ball mill for 72 to 96 hours. In a 1 oz. amber bottle was added 0.04 grams N,N'-diphenyl-N,N'-bis(3-methylphenyl)1,1'-biphenyl-4,4'-diamine, and 6.4 milliliters of tetrahydrofuran/toluene. Added to this solution was 2 grams of the ball milled slurry. The resulting mixture was placed on a shaker for 10 minutes and the slurry formed was then coated on the above photoconductive layer with a Bird applicator, in a wet thickness 0.5 mils. This device was allowed to air dry for 5 minutes. The dry thickness of the resulting photogenerating generator layer was 0.5 microns. This layer was dried at 135° C. for 6 minutes.

EXAMPLE X

A photoreceptive device was prepared by providing an aluminized Mylar substrate in a thickness of 3 mils and applying thereto in a wet thickness of 0.5 mils, a layer of 0.5 weight percent duPont 49,000 adhesive, in methylene chloride and 1,1,2-trichloroethane (4:1 volume ratio) with a Bird Applicator. This layer was then allowed to dry for one minute at room temperature, and 10 minutes at 100° C. in a forced air oven. The resulting layer had a dry thickness of 0.05 microns.

The above adhesive layer was overcoated with a charge transport layer which was prepared as follows.

A transport layer containing 50 percent by weight Makrolon$^R$, a polycarbonate resin having a molecular weight ($M_w$) of from about 50,000 to about 100,000 available from Larbensabricken Bayer, A.G., was mixed with 50 percent by weight N,N'-diphenyl-N,N'-bis(3-methylphenyl)1,1'-biphenyl-4,4'-diamine. This solution was mixed in 15 percent by weight of methylene chloride. All of these components were placed into an amber bottle and dissolved. The mixture was coated to a dry 25 micron thickness layer on top of the adhesive layer using a Bird applicator at a humidity equal to or less than 15 percent. This device was dried at 135 degrees centigrade for 6 minutes in a forced air oven.

A photoconductive layer containing 30 percent by volume of vanadyl phthalocyanine was then prepared as follows.

In a 2 oz. amber bottle was added 0.76 grams of duPont 49,000 polyester adhesive, and 16 ml of methylene chloride. Added to this solution was 0.36 grams of vanadyl phthalocyanine and 100 grams ⅛" stainless steel shot. The above mixture was placed on a ball mill for 24 hours. To 5 grams of this slurry was added 10 milliliters of methylene chloride. This slurry was coated on the above transport layer with a Bird applicator to a wet thickness of 0.5 mils. This layer was allowed to air dry for 5 minutes. The device was dried at 135° C. for 6 minutes in a forced air oven, to a dry thickness of 0.5 microns.

A photogenerator layer containing 33 percent by volume of trigonal selenium, and 13 percent by volume of N,N'-diphenyl-N,N'-bis(3-methylphenyl)1,1'-biphenyl-4,4'-diamine dispersed in a phenoxy resinous binder 54, percent by volume, was then prepared as follows.

In a 4 oz. amber bottle was added 1.6 grams of the phenoxy resin Bakelite, available from Union Carbide, 0.4 grams of N,N'-diphenyl-N,N'-bis(3-methylphenyl)1,1'-biphenyl-4,4'-diamine, 21 milliliters of methyl ethyl ketone, and 7 milliliters of methoxy ethyl acetate. Added to this solution was 3.2 grams of trigonal selenium, and 200 grams ⅛" stainless steel shot. The above mixture was placed on a ball mill for 72.96 hours. The slurry formed was then coated on the above photoconductive layer with a Bird applicator, to a wet thickness of 0.5 mil and, the resulting layer was allowed to air dry for 5 minutes to a dry thickness of 0.5 microns. The layer was then dried at 135° C. for 6 minutes in a forced air oven.

EXAMPLE XI

A photoreceptive device was prepared by providing an aluminized Mylar substrate in a thickness of 3 mils and applying thereto a layer of 0.5 percent by weight duPont 49,000 adhesive, a polyester available from duPont, in methylene chloride and 1,1,2-trichloroethane (4:1 volume ratio) with a Bird applicator, to a wet thickness of 0.5 mils. The layer was allowed to dry for one minute at room temperature, and 10 minutes at 100° C. in a forced air oven. The resulting layer had a dry thickness of about 0.05 microns.

The above adhesive layer was overcoated with a charge transport layer which was then prepared as follows.

A transport layer containing 50 percent by weight Makrolon$^R$, a polycarbonate resin having a molecular weight ($M_w$) of from about 50,000 to about 100,000 available from Larbensabricken Bayer A.G., was mixed with 50 percent by weight N,N'-diphenyl-N,N'-bis(3-methylphenyl)1,1'-biphenyl-4,4'-diamine. The resulting solution was mixed in 15 percent by weight of methylene chloride. All of these components were placed into an amber bottle and dissolved. The mixture was coated to a dry 25 micron thickness layer on top of the adhesive layer using a Bird applicator. During this coating process the humidity was equal to or less than 15 percent. This device was then dried at 135 degrees centigrade for 6 minutes in a forced air oven.

A photoconductive layer containing 30 percent by volume hydroxy squarylium was then prepared as follows.

In a 2 oz. amber bottle was added 0.76 grams Formvar 12/85, commercially available from Monsanto and 16 milliliters tetrahydrofuran. Added to this solution was 0.36 grams of hydroxy squarylium and 100 grams ⅛" stainless steel shot. The above mixture was placed on a ball mill for 24 hours. To 5 grams of this slurry was added 10 milliliters of additional solvent. This slurry was then coated on the above transport layer with a Bird applicator, to a wet thickness of 0.5 mils. The resulting device was dried at 135° C. for 6 minutes in a forced air oven. The dry thickness of the photoconductive layer was 0.5 microns.

A photogenerator layer containing 10 percent volume trigonal selenium, and 25 percent by volume of N,N'-diphenyl-N,N'-bis(3-methylphenyl)1,1'-biphenyl-4,4'-diamine and 65 volume percent of polyvinyl carbazole was then prepared as follows.

In a 2 oz. amber bottle was added 0.8 grams polyvinyl carbazole and 14 milliliters, 1:1 volume ratio, tetrahydrofuran:toluene. There was then added to this solution 0.8 grams of trigonal selenium and 100 grams of stainles steel shot, ⅛" in diameter. The above mixture was then placed on a ball mill for 72 to 96 hours. Subsequently, 5 grams of the resulting slurry were added to a solution of 0.18 grams of polyvinyl carbazole, and 0.15 grams of N,N'-diphenyl-N,N'-bis(3-methylphenyl)1,1'-biphenyl-4,4'-diamine, in 6.3 milliliters of tetrahydrofuran-toluene, volume ratio 1:1. This slurry was then placed on a shaker for 10 minutes. The resulting slurry was then coated on the above photoconductive layer with a Bird applicator, wet thickness 0.5 mils. This layer was then dried at 135° C. for 6 minutes in a forced air oven, resulting in a dry thickness of 2.0 microns.

EXAMPLE XII

A photoreceptive device was prepared by providing an aluminized Mylar substrate in a thickness of 3 mils, and applying thereto in a wet thickness of 0.5 mils, a layer of 0.5 percent by weight of duPont 49,000 adhesive, a polyester available from duPont, in methylene chloride and 1,1,2-trichloroethane (4:1 volume ratio) with a Bird applicator. The wet thickness was 0.5 mil. This layer was then allowed to dry for one minute at room temperature and 10 minutes at 100° C. in a forced air oven. The resulting layer had a dry thickness of about 0.05 microns.

The above adhesive layer was overcoated with a charge transport layer which was then prepared as follows.

A transport layer containing 50 percent by weight Makrolon$^R$, a polycarbonate resin having a molecular weight ($M_w$) of from about 50,000 to about 100,000 available from Larbensabricken Bayer A.G., was mixed with 50 percent by weight N,N'-diphenyl-N,N'-bis(3-methylphenyl)1,1'-diphenyl-4,4'-diamine. The resulting solution was mixed in 15 percent by weight of methylene chloride. All of these components were then placed into an amber bottle and dissolved. The mixture was coated to a dry 25 micron thickness layer on top of the above adhesive layer using a Bird applicator. During this coating process the humidity was equal to or less than 15 percent. This device was then dried at 135 degrees centigrade for 6 minutes in a forced air oven.

A photoconductive layer containing 30 percent by volume of hydroxy squarylium was then prepared as follows.

In a 2 oz. amber bottle was added 0.76 grams Formvar 12/85, and 16 milliliters tetrahydrofuran. Added to this solution was 0.36 grams of hydroxy squarylium and 100 grams ⅛" stainless steel shot. The above mixture was placed on a ball mill for 24 hours. To 5 grams of this slurry was added 10 milliliters of additional solvent. This slurry was then coated on the above transport layer with a Bird applicator, to a wet thickness of 0.5 mils. The resulting device was dried at 135° C. for 6 minutes in a forced air oven. The dry thickness of the photoconductive layer was 0.5 microns.

A photogenerator layer containing 30 percent by volume of trigonal selenium, 25 percent by volume of N,N'-diphenyl-N,N'-bis(3-methylphenyl)1,1'-biphenyl-4,4'-diamine and 45 volume percent of polyvinyl carbazole was prepared as follows.

In a 2 oz. amber bottle was added 0.8 grams polyvinyl carbazole and 18 milliliters, 1:1 volume ratio, tetrahydrofuran:toluene. There was then added to this solution 2.1 grams of trigonal selenium and 100 grams of stainless steel shot, ⅛" in diameter. The above mixture was then placed on a ball mill for 72 to 96 hours. In a 1 oz. amber bottle was added 0.04 grams N'-diphenyl-N,N'-bis(3-methylphenyl)1,1'-biphenyl-4,4'-diamine and 6.4 milliliters of tetrahydrofuran-toluene, volume ratio 1:1. Added to this solution was 2 grams of the ball milled slurry. This slurry was then placed on a shaker for 10 minutes. The resulting slurry was then coated on the above photoconductive layer with a Bird applicator, to a wet thickness 0.5 mils. This device was then allowed to air dry 1 to 5 minutes to a a dry thickness for the photogenerator layer of 0.5 microns. The resulting device was then dried at 135° C. for 6 minutes in a forced air oven.

EXAMPLE XIII

A photoreceptive device was prepared by providing an aluminized Mylar-substrate in a thickness of 3 mils, and applying thereto in a wet thickness of 0.5 mils, a layer of 0.5 percent by weight of duPont 49,000 adhesive, a polyester available from duPont, in methylene chloride and 1,1,2-trichloroethane (4:1 volume ratio) with a Bird applicator. The wet thickness was 0.5 mil. This layer was then allowed to dry for one minute at room temperature and 10 minutes at 100° C. in a forced air oven. The resulting layer had a dry thickness of about 0.05 microns.

The above adhesive layer was overcoated with a charge transport layer which was then prepared as follows.

A transport layer containing 50 percent by weight Makrolon$^R$, a polycarbonate resin having a molecular weight ($M_w$) of from about 50,000 to about 100,000 available from Larbensabricken Bayer A.G., was mixed with 50 percent by weight N,N'-diphenyl-N,N'-bis(3-methylphenyl)1,1'-biphenyl-4,4'-diamine. This solution was mixed in 15 percent by weight of methylene chloride. All of these components were placed into an amber bottle and dissolved. The mixture was coated to a dry 25 micron thickness layer on top of the above adhesive layer using a Bird applicator. During this coating process the humidity was equal to or less than 15 percent. The device was then dried at 135 degrees centigrade for 6 minutes in a forced air oven.

A photoconductive layer containing 30 percent by volume of hydroxy squarylium, was then prepared as follows.

In a 2 oz. amber bottle was added 0.76 grams Monsanto Formvar 12/85, and 16 ml. of tetrahydrofuran. Added to this solution was 0.36 grams of hydroxy squarylium and 100 grams ⅛" stainless steel shot. The above mixture was placed on a ball mill for 24 hours. To 5 grams of this slurry was added 10 milliliters of additional solvent. This slurry was then coated on the above transport layer with a Bird applicator, to a wet thickness of 0.5 mils. The resulting device was dried at 135° C. for 6 minutes in a forced air oven. The dry thickness of the photoconductive layer was 0.5 microns.

A photogenerator layer containing 33 percent by volume of trigonal selenium, and 13 percent by volume of N,N'-diphenyl-N,N'-bis(3-methylphenyl)1,1'-biphenyl-4,4'-diamine in the phenoxy binder Bakelite available from Union Carbide was then prepared as follows.

In a 4 oz. amber bottle was added 1.6 grams of the above phenoxy resin, 0.4 grams of N,N'-diphenyl-N,N'-bis(3-methylphenyl)1,1'-biphenyl-4,4'-diamine 21 milliliters methyl ethyl ketone and 7 milliliters methoxy ethyl acetate. Added to this solution was 3.2 grams of trigonal selenium, and 200 grams ⅛" stainless steel shot. The above mixture was placed on a ball mill for 72.96 hours. This slurry was then coated on the above photoconductive layer with a Bird applicator, to a wet thickness of 0.5 mils. This layer was allowed to air dry 2–5 minutes. The dry thickness was 0.5 microns. This layer was then dried at 135° C. in forced air for 6 minutes.

EXAMPLE XIV

A photoreceptive device was prepared by providing an aluminized Mylar substrate in a thickness of 3 mils, and applying thereto in a wet thickness of 0.5 mils a layer of 0.5 percent weight of duPont 49,000 polyester adhesive, in methylene chloride and 1,1,2-trichloroethane (4:1 volume ratio) with a Bird Applicator. The layer was allowed to dry for one minute at room temperature, and 10 minutes at 100° C. in a forced air oven. The dry thickness was about 0.05 microns.

The above adhesive layer was overcoated with a charge transport layer which was then prepared as follows.

A transport layer containing 50 percent by weight Makrolon$^R$, a polycarbonate resin having a molecular weight ($M_w$) of from about 50,000 to about 100,000 available from Larbensabricken Bayer A.G., was mixed with 50 percent by weight N,N'-diphenyl-N,N'-bis(3-methylphenyl)1,1'-biphenyl-4,4'-diamine. This solution was mixed in 15 percent by weight methylene chloride. All of these components were placed into an amber bottle and dissolved. The mixture was coated to a dry 25 micron thickness layer on top of the above adhesive layer using a Bird applicator. During this coating process the humidity was equal to or less than 15 percent. This device was then dried at 135 degrees centigrade for 6 minutes in a forced air oven.

A photogenerator layer containing 33 percent by volume of trigonal selenium and 13 percent by volume of N,N'-diphenyl-N,N'-bis(3-methylphenyl)1,1'-biphenyl-4,4'-diamine in a phenoxy resinous binder 54 percent by volume, was then prepared as follows.

In a 4 oz. amber bottle was added 1.6 grams of the above phenoxy resin, 0.4 grams of N,N'-diphenyl-N,N'-bis(3-methylphenyl)1,1'-biphenyl-4,4'-diamine, 21 milliliters methyl ethyl ketone and 7 milliliters methoxy ethyl acetate. Added to this solution was 3.2 grams trigonal selenium, and 200 grams ⅛" stainless steel shot. The above mixture was placed on a ball mill for 72–96 hours. This slurry was then coated on the above transport layer with a Bird applicator, to a wet thickness of 0.5 mils. The resulting device was allowed to air dry 2–5 minutes. The dry thickness of the photoconductive layer was 0.5 microns. The device layer was then dried at 135° C. in forced air for 6 minutes A photoconductive layer containing 30 percent by volume of vanadyl phthalocyanine was then prepared as follows.

In a 2 oz. amber bottle was added 0.76 grams of duPont 49,000, and 16 ml of methylene chloride. Added to this solution was 0.36 grams of vanadyl phthalocyanine and 100 grams ⅛" stainless steel shot. The above mixture was placed on a ball mill for 24 hours. To 5 grams of this slurry was added 10 milliliters of methylene chloride. This slurry was coated on the above photogenerating layer with a Bird applicator to a wet thickness of 0.5 mils. This layer was allowed to air dry for 5 minutes. The resulting device was dried at 135° C. for 6 minutes in a forced air oven. The dry thickness of the photoconductive layer was 0.5 microns.

EXAMPLE XV

A photoreceptive device was prepared by providing an aluminized Mylar substrate in a thickness of 3 mils, and applying thereto in a wet thickness of 0.5 mils, a layer of 0.5 percent by weight of duPont 49,000 adhesive, a polyester available from duPont, in methylene chloride and 1,1,2-trichloroethane (4:1 volume ratio) with a Bird applicator. The wet thickness was 0.5 mil. This layer was then allowed to dry for one minute at room temperature and 10 minutes at 100° C. in a forced air oven. The resulting layer had a dry thickness of about 0.05 microns.

The above adhesive layer was overcoated with a charge transport layer which was then prepared as follows.

A transport layer containing 50 percent by weight Makrolon$^R$, a polycarbonate resin having a molecular weight ($M_w$) of from about 50,000 to about 100,000 available from Larbensabricken Bayer A.G., was mixed with 50 percent by weight N,N'-diphenyl-N,N'-bis(3-methylphenyl)1,1'-biphenyl-4,4'-diamine. This solution was mixed in 15 percent by weight of methylene chloride. All of these components were placed into an amber bottle and dissolved. The mixture was coated to a dry 25micron thickness layer on top of the adhesive layer using a Bird applicator. During this coating process the humidity was equal to or less than 15 percent. This device wae then dried in a forced air oven at 135 degrees centigrade for 6 minutes.

A photogenerator layer containing 10 percent by volume of trigonal selenium, and 25 percent by volume of N,N'-diphenyl-N,N'-bis(3-methylphenyl)1,1'-biphenyl-4,4'-diamine and 65 volume percent of polyvinyl carbazole was prepared as follows.

In a 2 oz. amber bottle was added 0.8 grams polyvinyl carbazole and 14 milliliters, 1:1 volume ratio, tetrahydrofuran:toluene. There was then added to this solution 0.8 grams of trigonal selenium and 100 grams of stainless steel shot, ⅛" in diameter. The above mixture was then placed on a ball mill for 72 to 96 hours. In a 1 oz. amber bottle was added 0.15 grams N'-diphenyl-N,N'-bis(3-methylphenyl)1,1'-biphenyl-4,4'-diamine, 0.18 grams polyvinylcarbazole, and 6.3 milliliters of tetrahydrofuran-toluene, volume ratio 1:1. Added to this solution was 5 grams of the ball milled slurry. The slurry formed was then placed on a shaker for 10 minutes. The resulting slurry was then coated on the above transport layer with a Bird applicator, to a wet thickness 0.5 mils. This layer was then dried at 135° C. for 6 minutes in a forced air oven, resulting in a dry thickness for the generator layer of 2.0 microns.

The resulting device containing all of the above layers was annealed at 135° C. in a forced air oven for 6 minutes.

A photoconductive layer containing 30 percent by volume of hydroxy squarylium was prepared as follows.

In a 2 oz. amber bottle was added 0.76 grams Formvar 12/85, (Monsanto) and 16 milliliters of tetrahydrofuran. Added to this solution was 0.36 grams of hydroxy squarylium and 100 grams ⅛" stainless steel shot. The above mixture was placed on a ball mill for 24 hours. To 5 grams of this slurry was added 10 milliliters of additional solvent. This slurry was then coated on the above generator layer with a Bird applicator, to a wet thickness of 0.5 mils. The resulting device was dried at 135° C. for 6 minutes in a forced air oven. The dry thickness of the photoconductive layer was 0.5 microns.

EXAMPLE XVI

A photoreceptive device was prepared by providing an aluminized Mylar substrate in a thickness of 3 mils, and applying thereto in a wet thickness of 0.5 mils, a layer of 0.5 percent by weight of duPont 49,000 adhesive, a polyester available from duPont, in methylene chloride and 1,1,2-trichloroethane (4:1 volume ratio) with a Bird applicator. The wet thickness was 0.5 mil. This layer was then allowed to dry for one minute at room temperature and 10 minutes at 100° C. in a forced air oven. The resulting layer had a dry thickness of about 0.05 microns.

The above adhesive layer was overcoated with a charge transport layer which was then prepared as follows.

A transport layer containing 50 percent by weight Makrolon$^R$, a polycarbonate resin having a molecular weight ($M_w$) of from about 50,000 to about 100,000 available from Larbensabricken Bayer A.G., was mixed with 50 percent by weight N,N'-diphenyl-N,N'-bis(3-methylphenyl)1,1'-biphenyl-4,4'-diamine. This solution was mixed in 15 percent by weight of methylene chloride. All of these components were placed into an amber bottle and dissolved. The mixture was coated to a dry 25 micron thickness layer on top of the above adhesive layer using a Bird applicator. During this coating process the humidity was equal to or less than 15 percent. This device was then dried at 135 degrees centigrade for 6 minutes in a forced air oven.

A photogenerating layer containing 33 percent by volume of trigonal selenium, and 13 percent by volume of N,N'-diphenyl-N,N'-bis(3-methylphenyl)1,1'-biphenyl-4,4'-diamine in a Bakelite phenoxy binder was prepared as follows.

In a 4 oz. amber bottle was added 1.6 grams of the above phenoxy resin, 0.4 grams of N,N'-diphenyl-N,N'-bis(3-methylphenyl)1,1'-biphenyl-4,4'-diamine 21 milliliters methyl ethyl ketone and 7 milliliters methoxy ethyl acetate. Added to this solution was 3.2 grams trigonal selenium, and 200 grams ⅛" stainless steel shot. The above mixture was placed on a ball mill for 72–96 hours. The resulting slurry was then coated on the above transport layer with a Bird applicator, to a wet thickness of 0.5 mils. The resulting device was allowed to air dry 2.5 minutes, followed by drying at 135° C. in forced air for 6 minutes. The dry thickness of the photoconductive layer was 0.5 microns.

A photoconductive layer containing 30 percent by volume of hydroxy squarylium was then prepared as follows.

In a 2 oz. amber bottle was added 0.76 grams Monsanto, Formvar 12/85 and 16 ml of tetrahydrofuran. Added to this solution was 0.36 grams of hydroxy squarylium and 100 grams ⅛" stainless steel shot. The above mixture was placed on a ball mill for 24 hours. To 5 grams of this slurry was added 10 milliliters of additional solvent. The slurry formed was then coated on the above photogenerating layer with a Bird applicator, to a wet thickness of 0.5 mils. The resulting device was dried at 135° C. for 6 minutes in forced air oven. The dry thickness of the photoconductive layer was 0.5 microns.

Each of the devices of Examples III to XVI were overcoated with a top overcoating layer by coating a 1% solution of polyvinylbutyral in ethanol on each of the devices of these Examples using a Bird applicator with a wet thickness of 2 mils. The coating was then dried for 10 minutes and forced air dried at 50 degrees centigrade for 2 hours resulting in a thickness of 0.5 microns for each top overcoating layer.

Each of the above prepared devices were then tested for photosensitivity in the visible and infra-red region of the spectrum by positively charging the devices with corona to a +800 volts, followed by simulaneously exposing each device to monochromatic light in a wavelength range of from about 400 to about 1,000 nanometers. The surface potential of each device was then measured with an electrical probe after exposure to given wavelengths. The percent discharge of each device was then calculated as disclosed hereinbefore, which percent discharge indicates photoresponse.

The photoresponse devices of Examples III, IV and V, responded to light only in the wavelength of about 400 to 675 nanometers, indicating visible photosensitivity, while the photoresponsive devices of Examples VI and VII, responded to light in the wavelength of about 580 to 950 nanometers, with poor response in the blue and green wavelength range of the spectrum.

Figure 6:
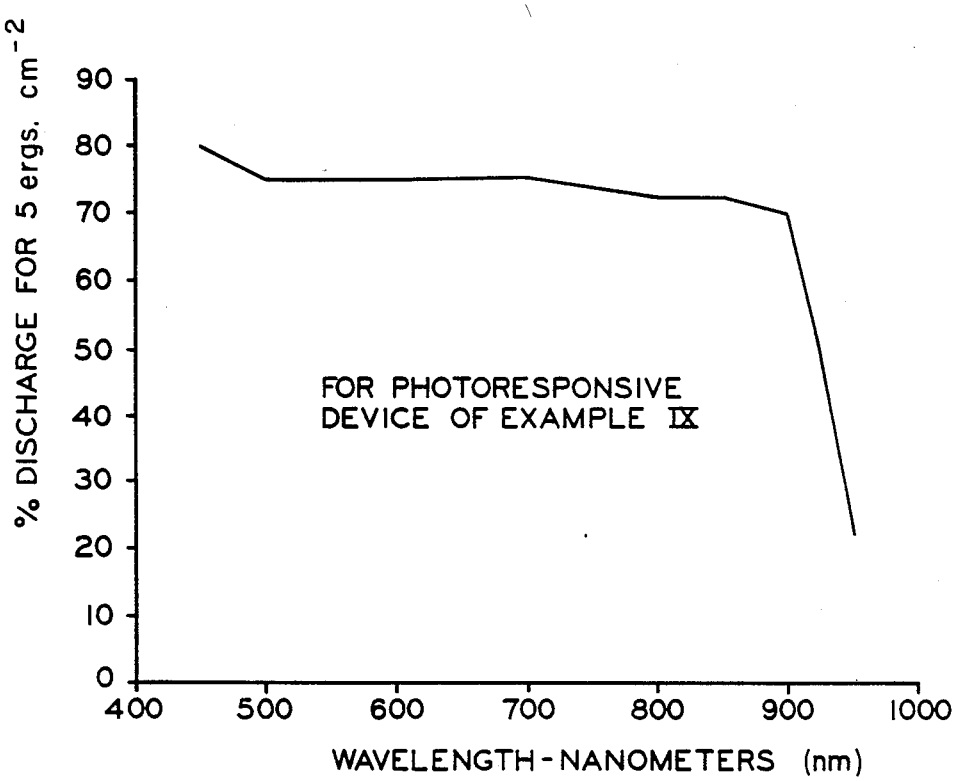
FIG. 6 represents the percent discharge for the photoresponsive device of the present invention, reference Example IX, for 5 Ergs cm-2 exposure of this device from a dark development potential ($V_{DDP}$) of 800 volts as a function of light exposed in the wavelength of 400 to 1,000 nanometers. This Figure demonstrates the visible and infra-red sensitivity of the devices of the present invention.

The devices as prepared in Examples VIII to XVI, had excellent response in the wavelength range of from about 400 to about 950 nanometers, indicating both visible and infra-red photosensitivity for these devices. Also the photoresponse of the device as prepared in Example IX is represented in FIG. 6.

Although the invention has been described with reference to specific preferred embodiments, it is not intended to be limited thereto, rather those skilled in the art will recognize variations and modifications may be made therein which are within the spirit of the invention and within the scope of the following claims.

I claim:

1. An improved photoresponsive device comprised in the order stated of the following layers: (1) a substrate (2) an adhesive layer, (3) a hole transport layer, (4) an inorganic, panchromatic photogenerating layer, (5) a photoconductive composition sensitive in the red or infrared region of the spectrum, which composition is selected from the group consisting of organic photoconductive compositions, charge transfer complex compositions, dye sensitizers, or mixtures thereof and (6) an polymeric overcoating layer.

2. An improved photoresponsive device comprised in the order stated of the following layers: (1) a substrate, (2) an adhesive layer, (3) a hole transport layer, (4) a photoconductive composition sensitive in the red or infrared red region of the spectrum, which composition is selected from the group consisting of organic photoconductive compositions, charge transfer complex compositions, dye sensitizers, or mixtures thereof, (5) an inorganic panchromatic photogenerating layer and (6) an polymeric overcoating layer.

3. An improved photoresponsive device in accordance with claim 1 wherein the substrate is conductive, and the adhesive layer is comprised of a polyester resin.

4. An improved photoresponsive device in accordance with claims 2 wherein the substrate is conductive, and the adhesive layer is comprised of a polyester resin.

5. An improved photoresponsive device in accordance with claim 1 wherein the photoconductive layer is comprised of an organic photoconductive material.

6. An improved photoresponsive device in accordance with claim 2 wherein the photoconductive layer is comprised of an organic photoconductive material.

7. An improved photoresponsive device in accordance with claim 5 wherein the organic photoconductive material is a phthalocyanine composition.

8. An improved photoresponsive device in accordance with claim 6 wherein the organic photoconductive material is a phthalocyanine composition.

9. An improved photoresponsive device in accordance with claim 7 wherein the phthalocyanine, is vanadyl phthalocyanine.

10. An improved photoresponsive device in accordance with claim 8 wherein the phthalocyanine is a metal free phthalocyanine.

11. An improved photoresponsive device in accordance with claim 7 wherein the phthalocyanine is chloroaluminum phthalocyanine chloride, or copper phthalocyanine.

12. An improved photoresponsive device in accordance with claim 8 wherein the phthalocyanine is copper phthalocyanine or orchloroaluminum phthalocyanine chloride.

13. An improved photoresponsive device in accordance with claim 5 wherein the organic photoconductive material is a squarylium composition of the formula:

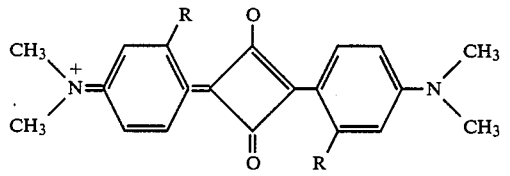

wherein R is hydrogen, an alkyl group and a hydroxy (OH) group.

14. An improved photoresponsive device in accordance with claim 6 wherein the organic photoconductive material is a squarylium composition of the formula:

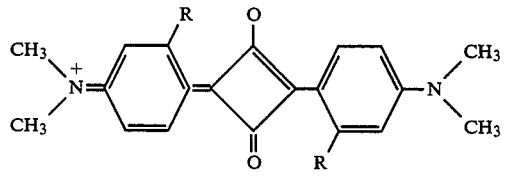

wherein R is selected from the group consisting of hydrogen, an alkyl group, and a hydroxy (OH) group.

15. An improved photoresponsive device in accordance with claim 13 wherein the squarylium composition is a hydroxy squarylium, a methyl squarylium or an unsubstituted squarylium.

16. An improved photoresponsive device in accordance with claim 14 wherein the squarylium composition is a hydroxy squarylium, a methyl squarylium or an unsubstituted squarylium.

17. An improved photoresponsive device in accordance with claim 1 wherein the inorganic photogenerating layer is selected from the group consisting of trigonal selenium and trigonal selenium doped with sodium carbonate, or sodium selenite.

18. An improved photoresponsive device in accordance with claim 2 wherein the photogenerating layer is trigonal selenium, trigonal selenium doped with sodium carbonate, and sodium selenite.

19. An improved photoresponsive device in accordance with claim 1 wherein the thickness of the adhesive layer is from about 0.01 microns to about 0.3 microns, the thickness of the photogenerating layer is from about 0.1 microns to about 10 microns, when the photogenerating layer contains from about 5 percent to about 100 percent by volume of photogenerating composition, and the thickness of the photoconductive layer is from about 0.1 microns to about 10 microns, when the photoconductive composition contains from about 5 percent to about 100 percent by volume of photoconductive composition.

20. An improved photoresponsive device in accordance with claim 2 wherein the thickness of the adhesive layer is from about 0.01 microns to about 0.3 microns, the thickness of the photogenerating layer is from about 0.1 microns to about 10 microns, when the photogenerating layer contains from about 5 percent to about 100 percent by volume of photogenerating composition, and the thickness of the photoconductive layer is from about 0.1 microns to about 10 microns, when the photoconductive composition contains from about 5 percent to about 100 percent by volume of photoconductive composition.

21. An improved photoresponsive device in accordance with claim 1 wherein the photogenerating layer is comprised of an inorganic photoconductive composition dispersed in a resinous binder, and the photoconductive layer is comprised of an organic photoconductive composition dispersed in a resinous binder.

22. An improved photoresponsive device in accordance with claim 2 wherein the photogenerating layer is comprised of an inorganic photoconductive composition dispersed in a resinous binder, and the photoconductive layer is comprised of an organic photoconductive composition dispersed in a resinous binder.

23. An improved photoresponsive device in accordance with claim 21 wherein the resinous binder for the photogenerating layer is a poly(hydroxyether), or a polyvinylcarbazole.

24. An improved photoresponsive device in accordance with claim 22 wherein the resinous binder for the photogenerating layer is a polyvinylcarbazole, or a poly(hydroxyether).

25. An improved photoresponsive device in accordance with claim 21 wherein the resinous binder for the photoconductive layer is a polycarbonate, a polyester, or polyvinylcarbazole.

26. An improved photoresponsive device in accordance with claim 22 wherein the resinous binder for the photoconductive layer is a polyester, a polycarbonate, or polyvinylcarbazole.

27. An improved photoresponsive device in accordance with claim 1 wherein the hole transport layer comprises molecules of the formula:

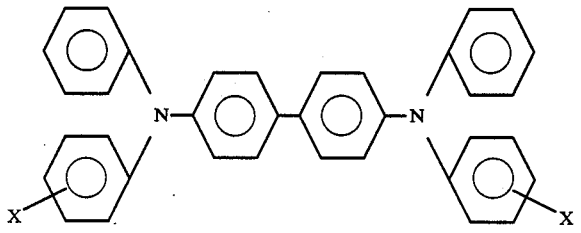

dispersed in a highly insulating and transparent organic resinous material wherein X is selected from the group consisting of (ortho) $CH_3$, (meta) $CH_3$, (para) $CH_3$, (ortho) Cl, (meta) Cl, (para) Cl.

28. An improved photoresponsive device in accordance with claim 2 wherein the hole transport layer comprises molecules of the formula:

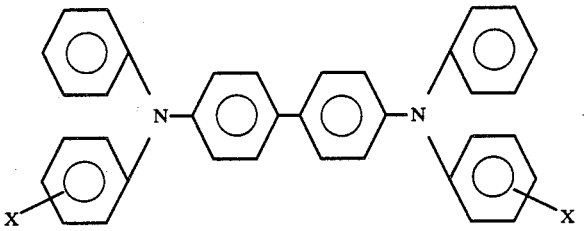

dispersed in a highly insulating and transparent organic resinous material wherein X is selected from the group consisting of (ortho) $CH_3$, (meta) $CH_3$, (para) $CH_3$, (ortho) Cl, (meta) Cl, (para) Cl.

29. An improved photoresponsive device in accordance with claim 27 wherein the transport layer is comprised of N,N'-diphenyl-N,N'-bis(3-methylphenyl)-[1,1-biphenyl]-4,4'-diamine, and the resinous binder is polycarbonate having a molecular weight of from about 20,000 to about 100,000.

30. An improved photoresponsive device in accordance with claim 28 wherein the transport layer is comprised of N,N'-diphenyl-N,N'-bis(3-methylphenyl)-[1,1-biphenyl]-4,4'-diamine, and the resinous binder is a polycarbonate having a molecular weight of from about 20,000 to about 100,000.

31. An improved photoresponsive device in accordance with claim 25 wherein the resinous binder contains from about 10 percent by weight to about 75 percent by weight of the active molecules.

32. An improved photoresponsive device in accordance with claim 28 wherein the resinous binder contains from about 10 percent by weight to about 75 percent by weight of the active molecules.

33. An improved photoresponsive device in accordance with claim 27 wherein the hole transport layer is of a thickness of from about 5 microns to about 50 microns.

34. An improved photoresponsive device in accordance with claim 28 wherein the charge transport layer is of a thickness of from about 5 microns to about 50 microns.

35. An improved photoresponsive device in accordance with claim 1 wherein the polymeric overcoating is a polyester, polyvinylbutyal, a polycarbonate, or a phenoxy resin.

36. An improved photoresponsive device in accordance with claim 2 wherein the polymeric overcoating is a polyester, polyvinylbutyral, a polycarbonate, or a phenoxy resin.

37. An improved photoresponsive device in accordance with claim 1 wherein the substrate is indium-tin oxide.

38. An improved photoresponsive device in accordance with claim 2 wherein the substrate is indium-tin oxide.

39. An improved photoresponsive device in accordance with claim 8 wherein the phthalocyanine is vanadyl phthalocyanine.

40. An improved photoresponsive device in accordance with claim 7 wherein the phthalocyanine is a metal free phthalocyanine.

41. An improved photoresponsive device consisting essentially of (1) a supporting substrate, (2) an optional adhesive layer, (3) a hole transport layer containing molecules of the formula

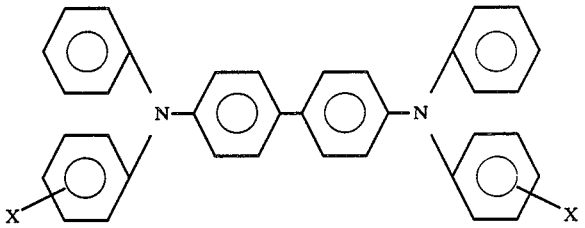

dispersed in a highly insulating and transparent organic resinous material, wherein X is selected from the group consisting or (ortho) $CH_3$, (metal) $CH_3$, (para) $CH_3$, (ortho) Cl, (meta) Cl, (para) Cl, (4) an inorganic, pnchromatic photogenerating layer, (5) a photoconductive composition sensitive in the red or infrared region of the spectrum, which composition is selected from the group consisting of organic photoconductive compositions, charge transfer complex compositions, dye sensitizers, or mixtures thereof and (6) a polymeric overcoating layer selected from the group consisting of polyesters, polyvinylbutyral, polycarbonates, and phenoxy resins.

42. An improved photoresponsive device in accordance with claim 41, wherein the photoconductive composition is situated between the hole transport layer and the inorganic photogenerating layer.

43. An improved photoresponsive device in accordance with claim 41, wherein the polymeric overcoating is polyvinylbutyral.

44. An improved photoresponsive device in accordance with claim 43, wherein the polymeric overcoating is polyvinylbutryal.

* * * * *